US008021172B2

(12) United States Patent
Shunjie

(10) Patent No.: US 8,021,172 B2
(45) **Date of Patent: *Sep. 20, 2011**

(54) ROTARY RECEPTACLE ASSEMBLY

(75) Inventor: Lu Shunjie, Dong Guan (CN)

(73) Assignee: Pulse Design, Inc., Grand Rapids, MI (US)

( * ) Notice: Subject to any disclaimer, the term of this patent is extended or adjusted under 35 U.S.C. 154(b) by 67 days.

This patent is subject to a terminal disclaimer.

(21) Appl. No.: 12/577,484

(22) Filed: Oct. 12, 2009

(65) Prior Publication Data

US 2010/0041258 A1 Feb. 18, 2010

Related U.S. Application Data

(63) Continuation-in-part of application No. 12/051,867, filed on Mar. 20, 2008, now Pat. No. 7,621,764.

(51) Int. Cl.
*H01R 13/44* (2006.01)

(52) U.S. Cl. ..... 439/131; 174/480

(58) Field of Classification Search ..... 439/131–142; 174/480

See application file for complete search history.

(56) References Cited

U.S. PATENT DOCUMENTS

| | | | | |
|---|---|---|---|---|
| 3,794,956 | A * | 2/1974 | Dubreuil | 439/131 |
| D412,695 | S | 8/1999 | Byrne | |
| D412,698 | S | 8/1999 | Byrne | |
| 6,028,267 | A | 2/2000 | Byrne | |
| 6,234,812 | B1 * | 5/2001 | Ivers et al. | 439/131 |
| 6,290,518 | B1 | 9/2001 | Byrne | |
| 6,416,336 | B1 * | 7/2002 | Schulte et al. | 439/131 |
| D463,775 | S | 10/2002 | Byrne | |
| D468,701 | S | 1/2003 | Byrne | |
| D472,213 | S | 3/2003 | Byrne | |
| D535,257 | S | 1/2007 | Byrne | |
| 7,162,409 | B2 | 1/2007 | Noma | |
| 7,285,733 | B2 * | 10/2007 | Bowman | 174/480 |
| 7,341,463 | B2 * | 3/2008 | Lai | 439/131 |

* cited by examiner

*Primary Examiner* — Truc Nguyen

(74) *Attorney, Agent, or Firm* — Barry C. Kane; Kane & Co., PLC

(57) ABSTRACT

A new rotary receptacle assembly comprises a frame assembly and a drum assembly journaled to the frame assembly so that the drum assembly may rotate relative to the frame assembly. Mounted to the drum assembly is at least one receptacle. A motor assembly may be mounted to one of the frame assembly and the drum assembly for imparting rotary motion to the drum assembly relative to the frame assembly. A clutch assembly disposed on one of the frame assembly or the drum assembly is coupled to the motor assembly. At least one sensor assembly is mounted on the drum assembly and operably coupled to the motor assembly via a rotation control circuit for preventing, among other things, the motor assembly from operating or changing the direction of rotation when an object obstructs the rotation of the drum assembly.

20 Claims, 9 Drawing Sheets

ROTARY RECEPTACLE ASSEMBLY

CROSS REFERENCE TO RELATED APPLICATION

This application is a continuation-in-part application under 37 C.F.R. 1.53 of U.S. patent application Ser. No. 12/051,867 filed Mar. 20, 2008 which claims priority under 35 U.S.C.§119 to Chinese Patent Application Serial No. 200720121712.4 filed Jul. 24, 2007.

BACKGROUND OF THE INVENTION

1. Field of the Invention

This invention relates to power and data centers, and particularly to a desktop mounted, rotary receptacle assembly providing power and data connections for use with furniture.

2. Brief Description of the Related Art

Generally speaking, electrical outlets, internet connection points, telephone sockets, VGA interfaces, audio frequency interfaces, and microphone speaker interfaces are separated. Moreover, they are usually mounted at fixed locations on walls, placed on the floor or appear on electrical devices, which make them very inconvenient to use. If they are fixed directly onto furniture, they are often aesthetically unattractive and often difficult to be installed. In addition, the power and data sockets in current devices are usually exposed, which make them unsafe to use and not durable. Moreover, to the best of the inventor's knowledge, all previous desk top power and data couplers have been manually or spring operated. When use has been discontinued, the module remains open and unsightly, and creating a risk for damage and/or injury in the event of inadvertent connectivity to the power supply resulting in possible electrical shock and injury.

SUMMARY OF THE INVENTION

An object of this invention is to overcome the shortcomings described above and provides an integrated rotary receptacle assembly combining electrical outlets, internet connection points, telephone sockets, video graphics adaptor interface, an audio frequency interface, and a microphone speaker interface in a safe and durable package.

Another object of the invention is to provide a rotary receptacle assembly wherein a rotating drum containing a plurality of receptacles may be motorized to rotate between a first position concealing the receptacles from view and a second position where the receptacles may be accessed by a user.

Another object of the invention is to provide a unique circuit assembly for automatically changing the rotation direction of the rotating drum based upon completion of the rotary cycle or upon sensing a strain suggesting an obstruction.

Another object of the invention is to provide a unique clutch plate mechanism for preventing damage to the drum assembly and the overall unit when the rotation of the drum assembly is prevented from occurring.

Another object of the invention is to provide a unique clutch plate mechanism that permits the operator to manually rotate the drum assembly between the concealed and revealed positions in the event of a power loss.

Another object of the invention is to provide a system that automatically prevents the rotation of the drum assembly between an exposed position and a concealed position when an object may be disposed in or on one of the receptacles.

In one embodiment of the invention, a frame assembly is provided for supporting a drum assembly upon which are electrical outlets, internet connection points, telephone sockets, a VGA interface, an audio frequency interface, and a microphone speaker interface.

In addition, the drum assembly containing the electrical outlets, internet connection points, telephone sockets, a VGA interface, an audio frequency interface, and a microphone speaker interface is able to rotate within the frame assembly. When the electrical outlets, internet connection points, telephone sockets, a VGA interface, an audio frequency interface, and a microphone speaker interface rotate 180° when not used, providing an aesthetically pleasing look.

In order to ensure that the electrical outlets, internet connection points, telephone sockets, a VGA interface, an audio frequency interface, and a microphone speaker interface can rotate within the frame assembly in a stable manner, the rotatable drum is journaled to the frame assembly by way of a clutch plate. The various receptacles and outlets are located within the drum and rotate together with it. Furthermore, the rotatable drum includes a rotation control unit that controls the rotation of the rotatable drum.

The rotation control unit includes detectors that test whether the receptacle assembly is being used, a control circuit assembly that performs its control functions based on the received detection signal of the detectors, and a rotating motor controlled by a control circuit assembly. The rotating motor is capable of driving the rotation of the rotational frame assembly.

The detectors are comprised of two photoelectric detection devices located above the rotational frame assembly. These two photoelectric detection devices are situated on opposite ends of the array of electrical outlets, internet connection points, telephone sockets, VGA interface, audio frequency interface, and microphone speaker interface as mentioned above. Optimally, two photoelectric detection devices include two infrared detectors. Each of the devices transmits infrared signals toward the other device, and each is able to receive infrared signals and transmit the received infrared detection signal to the control circuit assembly.

The control circuit assembly includes a CPU circuit, an indicator, and rotation switches capable of controlling a motor's positive and negative rotation to achieve visibility or invisibility of the rotatable drum.

As a further improvement to the technical design described above, the rotation control unit also includes a rotation disc located on the side of the frame assembly. The rotating motor shaft is inserted into the center of the rotational disc at the flat position. On the rotation disc is an annulus or ring-shaped fixed piece of iron in circumferential direction. There are several fixed magnets fitted in the position that corresponds to the frame assembly and the rotation disc. The annulus on the rotation disc corresponds to the magnets on the frame assembly. The torque force of the attraction between the annulus and the magnets on the frame assembly is greater than the rotation power of the rotation frame assembly. In this manner, the rotation disc and the frame assembly are kept in a relatively immovable position by the magnetism and remain so when the rotating motor drives the rotation of the rotatable drum.

According to one form of the invention, a concealable receptacle assembly, is provided comprising a frame assembly; a drum assembly journaled to the frame assembly so that the drum assembly may rotate relative to the frame assembly, the drum assembly including at least one receptacle; a motor assembly mounted to one of the frame assembly and the rotatable drum assembly for imparting rotary motion to the drum assembly relative to the frame assembly; a clutch assembly coupled to motor assembly; and a sensor assembly mounted on the drum assembly and operably coupled to the motor assembly for preventing the motor assembly from operating when an object is detected by the sensor assembly.

The invention may further comprise a second sensor assembly mounted to one of the frame assembly and the drum assembly for detecting a predetermined rotation angle of the drum assembly relative to the frame assembly and interrupting the motor assembly. The frame assembly may comprise a first and a second end member spaced from one another, each of the first and second end members including a member for journaling the drum assembly there between, a plurality of spans interconnecting the first and second end members, the first and the second end members and the plurality of spans including a flange structure for engaging a surface of a substrate. The drum assembly may comprise a cylindrical body having first and second opposing ends, and a journal member mounted to each of the first and second ends for defining an axis of rotation for the drum assembly, wherein at least one receptacle is mounted to a predetermined position on the cylindrical body. Alternatively or in addition, the clutch assembly may include a clutch recess formed in the frame assembly, and a clutch plate coupled to an end of the motor assembly and disposed within the clutch recess in intimate contact with a surface of the frame assembly to create a frictional contact. Alternatively the clutch assembly may include a clutch plate coupled to an end of the motor assembly and disposed within the clutch recess, a magnetic material attached to a surface of one of the clutch recess and the clutch plate; and at least one magnet attached to an opposite one of the clutch recess and the clutch plate having the magnetic material attached thereto to create a magnetic flux rendering the clutch plate substantially fixed. The sensor assembly may include a first detector mounted to the drum assembly proximate one end, a second detector mounted to the drum assembly proximate an opposite end and able to detect a signal generated by the first detector and send a signal to the first detector, a control circuit unit operably interconnected to the first detector and the second detector, and a CPU circuit operably coupled to the control circuit unit and to the first and the second detector and to the motor assembly for operably controlling the motor assembly.

According to another form of the invention, an assembly is provided for selectively revealing and concealing at least one receptacle, comprising a frame assembly disposed within a recess formed in a substrate, a drum journaled to the frame assembly such that the drum is able to rotate about at least one axis relative to the frame assembly, at least one receptacle selected from an electrical outlet, a network interface connection, a telephone jack, a video graphics adapter port, and a multimedia port and mounted to the drum, a clutch in contact with the frame assembly; a motor assembly mounted concentrically within the drum and interconnected to the frame assembly by the clutch for selectively imparting rotational movement to the drum about at least one axis to move the at least one receptacle from a concealed position to a revealed position, and a sensor array mounted to the drum for selectively operating the motor assembly based upon one of an angle of rotation and obstruction at a receptacle. The sensor array mentioned above may comprise a detector array for detecting whether the assembly is in use. The detector array may include a first and a second photoelectric sensor mounted to the drum on opposite sides of the receptacle. The first and second photo-electric sensors may be selected from the group of invisible light and visible light devices.

The advantages of this new practical model are that on the rotary receptacle assembly, in addition to electrical outlets, there are internet connection points, telephone sockets, a VGA interface, an audio frequency interface, and a microphone speaker interface. Such a multifunctional assembly can be directly fitted onto furniture or in some other places, which makes it very easy to use. As the sockets of different functions are in the same frame assembly, it saves space and can make room look nice and tidy; and that the electrical outlets, the internet connection points, the telephone sockets, the VGA interface, the audio frequency interface, and the microphone speaker interface can rotate simultaneously within the said frame assembly. When the electrical outlets, internet connection points, telephone sockets, a VGA interface, an audio frequency interface, and a microphone speaker interface rotate 180° when not used, they can be made invisible within the frame assembly. This avoids accidents caused by water spillage or the presence of foreign bodies. As such, it is safe, durable and looks pleasant. On the rotatable drum is a rotation control unit that controls the rotation of the rotatable parallel unit. The rotation control unit includes detectors that test whether the receptacle assembly is being used, a control circuit assembly that performs its control functions based on the received detection signal of the detectors, and a rotating motor controlled by a control circuit assembly. The rotating motor is capable of driving the rotation of the rotational frame assembly. Such a design can ensure that this new practical design will not cause the problem of inadvertent rotation resulting in such accidents as trapped wires or hands. Only when not a single socket is being used can the plug unit be rotated to hide all the socket bores for the reason of safety. The said rotation control unit also includes a rotation disc. There are several fixed magnets on the frame assembly, and in the position that corresponds to the rotation disc, there is a ring-shaped fixed piece of iron. In this way, the rotation disc and the frame assembly are kept in a relatively immovable position by the magnetism and remain so when the rotating motor drives the rotation of the rotatable drum.

BRIEF DESCRIPTION OF THE DRAWING FIGURES

DETAILED DESCRIPTION OF THE VARIOUS EMBODIMENTS OF THE INVENTION

Figure 1:
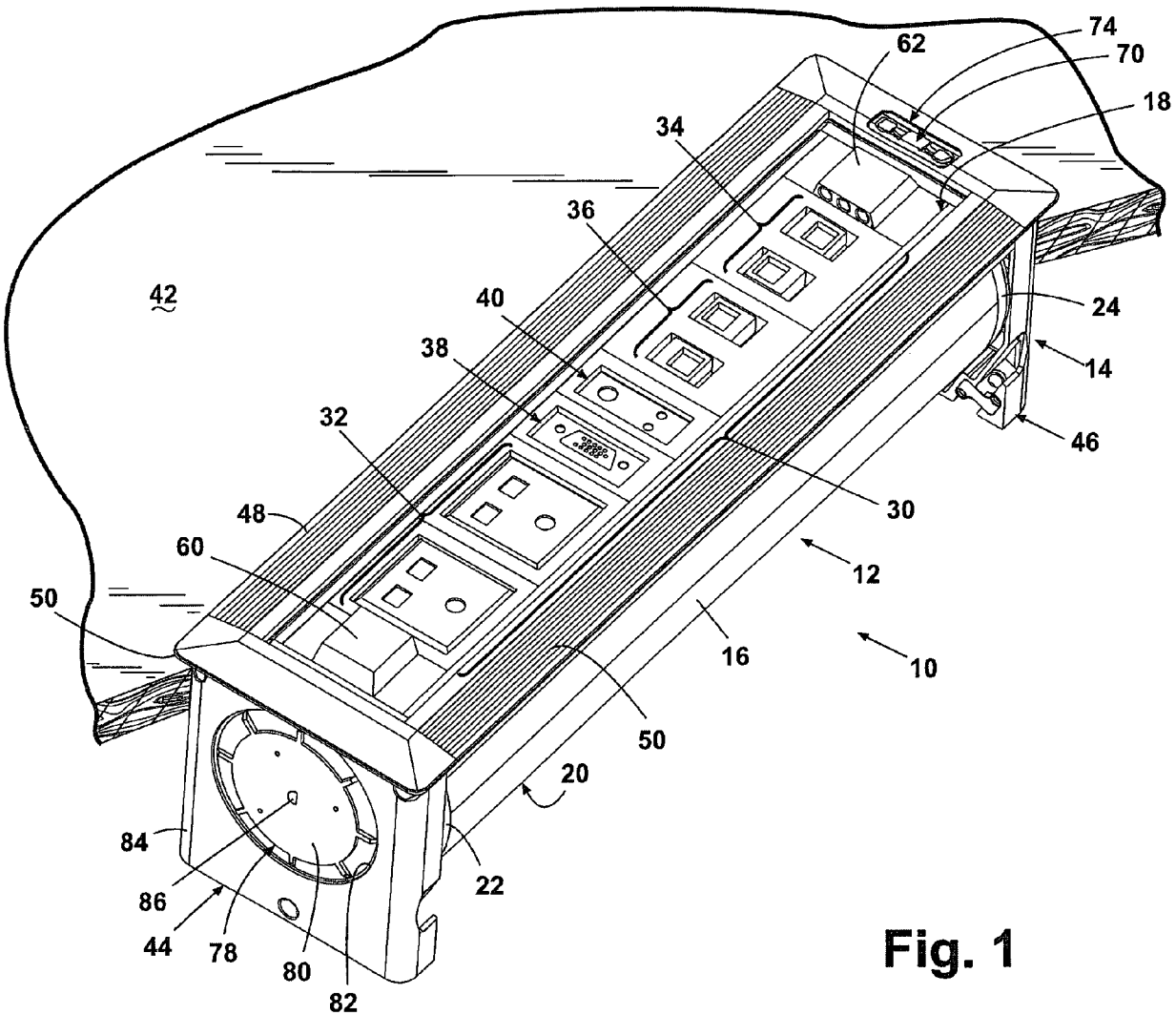
FIG. 1 is an oblique view of a rotary receptacle assembly comprising the invention.

For purposes of the following description, the terms "upper," "lower," "left," "rear," "front," "vertical," "horizontal" and derivatives of such terms shall relate to the invention as oriented in FIG. 1. However, it is to be understood that the invention may assume various alternative orientations and configuration, except where expressly specified to the contrary. It is also to be understood that the devices and processes illustrated in the attached drawings, and described in the following specification are simply exemplary embodiments of the inventive concepts defined in the inventive concepts of this invention. Specific dimensions and other physical characteristics relating to the embodiments disclosed herein are not to be considered as limiting unless expressly stated otherwise.

FIG. 1 is an oblique view of a first embodiment of a rotary receptacle assembly or rotary power and data center 10. The assembly 10 is comprised of a drum assembly 12 and a frame assembly 14. The drum assembly 12 may have a generally cylindrical tubular body 16. In one embodiment the tubular body 16 may also include two opposing flat exterior surfaces 18 and 20 extending longitudinally along the length of the body 16. The tubular body 16 may be closed at each end by an end cap 22 and 24 that each include a journal member 26 and 28 that are received by and interact with like shaped recesses formed in the frame assembly 14 and permit the drum assembly 12 to rotate about its longitudinal axis which extends concentrically between the journal members 26 and 28.

Mounted flush with one of the surfaces 18 and 20 are a plurality of receptacles 30 including at least one or more selected from the group consisting essentially of electrical outlets 32, network interface connections 34 (NIC, Ethernet, CAT 4, CAT 5 or CAT 6 or similar connections), telephone jacks 36, video graphics adaptors (VGA, S-video or similar) port 38, and multi-media ports 40 including microphone, headphone, and/or audio-in ports. The receptacles 30 may be arranged in any combination or in any order. Regardless of the combination of the receptacles, each is preferably fixed with respect to the drum assembly 12 so they remain in position as the drum assembly 12 is rotated about its longitudinal axis relative to the frame assembly 14. It is anticipated that the drum assembly 12 and the end caps 22 and 24 forming the journal members 26 and 28 may be made from any one of a number of materials including, but not limited to, polymer materials such as plastic, PVC, and related materials, steel, aluminum, fibreglass, carbon fibre, or other materials to provide a relatively rigid structure. Likewise the frame assembly 14 may be manufactured from a like range of materials.

Figure 2:
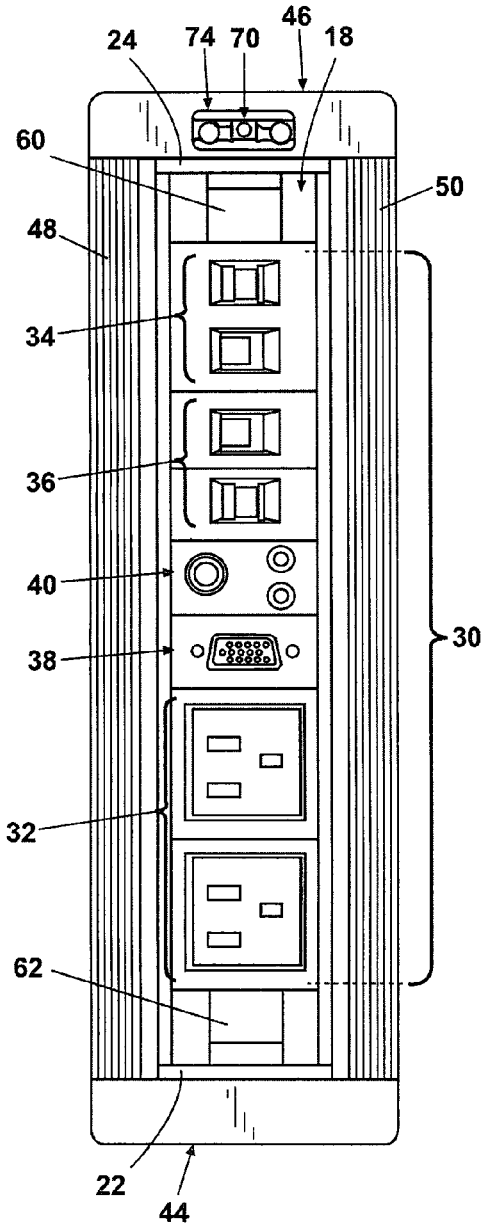
FIG. 2 is a plan view of the rotary receptacle assembly shown in a first orientation or mode of operation.
Figure 3:
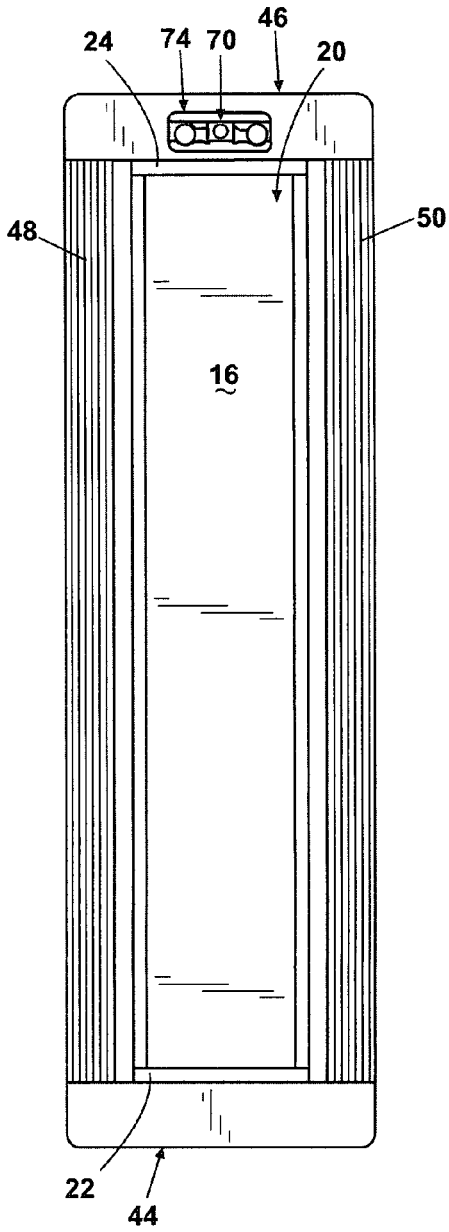
FIG. 3 is a plan view of the rotary receptacle assembly shown in FIG. 2 in a second orientation or mode of operation.

FIG. 2 is a plan view of the assembly 10 shown in FIG. 1 with the drum assembly 12 in a first orientation or mode of operation. FIG. 3 is a plan view of the assembly 10 as shown in FIG. 2 with the drum assembly 12 in a second or orientation or mode of operation concealing the receptacles 30 from view. If FIG. 2 and FIG. 3 are compared with each other, it can be observed that when the rotatable drum assembly 12 is rotated a predetermined angle about its longitudinal axis, the receptacles 30 may be moved between a concealed position and an exposed position. The advantages of such a design are that the assembly 10 can avoid such problems as accidental exposure to electrical current or physical damage caused by the presence of foreign bodies. Furthermore, when it is not used, the assembly 10 provides a nice, clean, aesthetic look on the surface of the substrate 42.

As briefly mentioned above, the frame assembly 14 may be formed from a number of different types of materials and structures. The overall purpose of the frame assembly 14 is to provide a structure for suspending the drum assembly 12 within an item of furniture such as a conference table, desk, or workstation. Alternatively the frame assembly 14 may support the drum assembly 12 in a surface that is oriented vertically such as a wall or cubical divider. In one embodiment shown in FIGS. 4, 5 and 7, the frame assembly 14 is comprised of two opposing end members 44 and 46 disposed at opposite ends of the drum assembly 12. Each end member 44 and 46 includes a cooperating mating structure adapted to interact with a respective one of the journal member 26 and 28 extending from the end caps 22 and 24 closing the ends of the tubular body 16 of the drum assembly 12. The respective end members 44 and 46 may be interconnected by a plurality of upper beams or spans 48 and 50, and a lower span 52 to provide a substantially rigid frame assembly 14. The upper spans 48 and 50 extending between the upper edge of each end member 44 and 46 may have a cross-sectional profile that provides an outwardly disposed or peripheral lip 54 designed to overlap and lie adjacent any substrate 42 and help keep the rotary receptacle assembly 10 substantially flush with any adjacent surface. The upper edge of each end member 44 and 46 may also include a similar lip, flange or overhang to provide a similar support at the ends of the assembly 10. The remaining span 52 of the three described above may be positioned to interconnect the lower edges of the two end members 44 and 46 to fix the lower end of the frame assembly 14. It is anticipated that the spans or beams 48, 50, and 52 may be made from aluminum, polymeric materials, steel, or other substantially rigid material.

Figure 6:
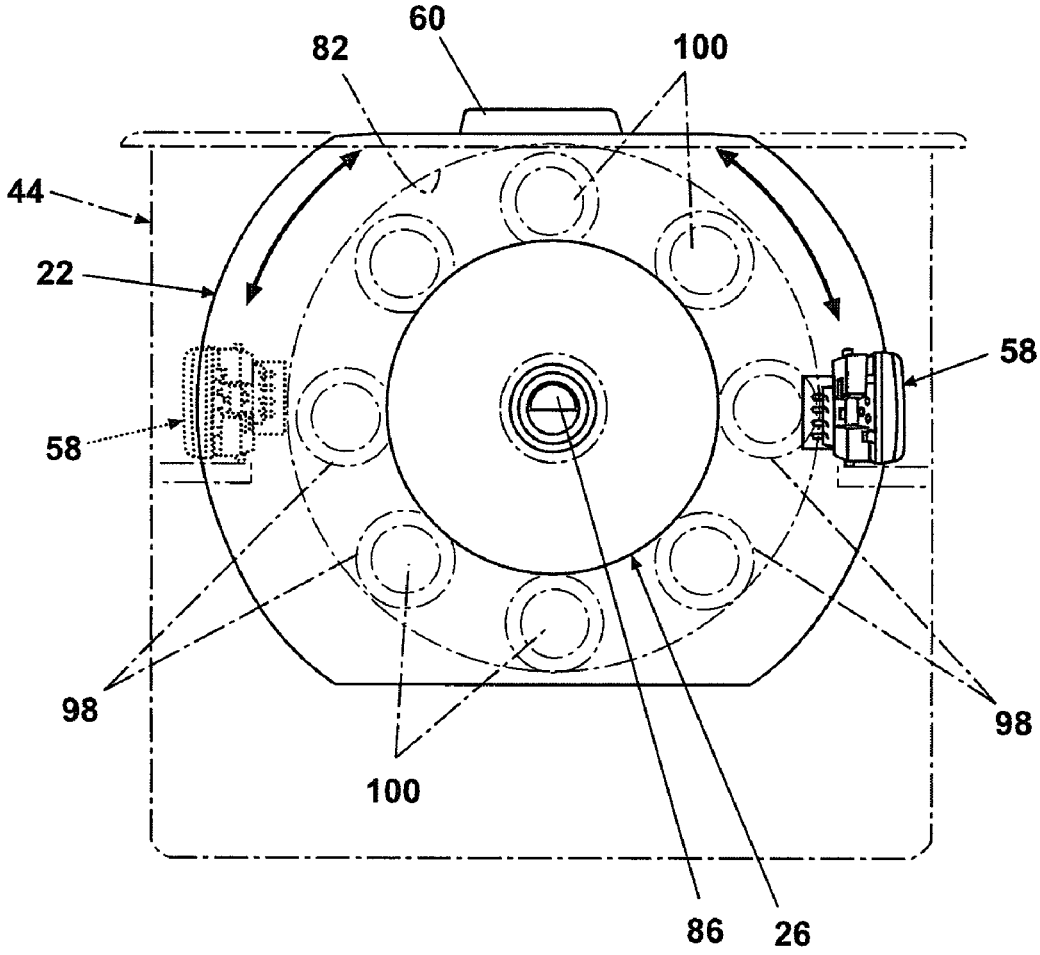
FIG. 6 is an end view of the rotatable drum assembly.
Figure 7:
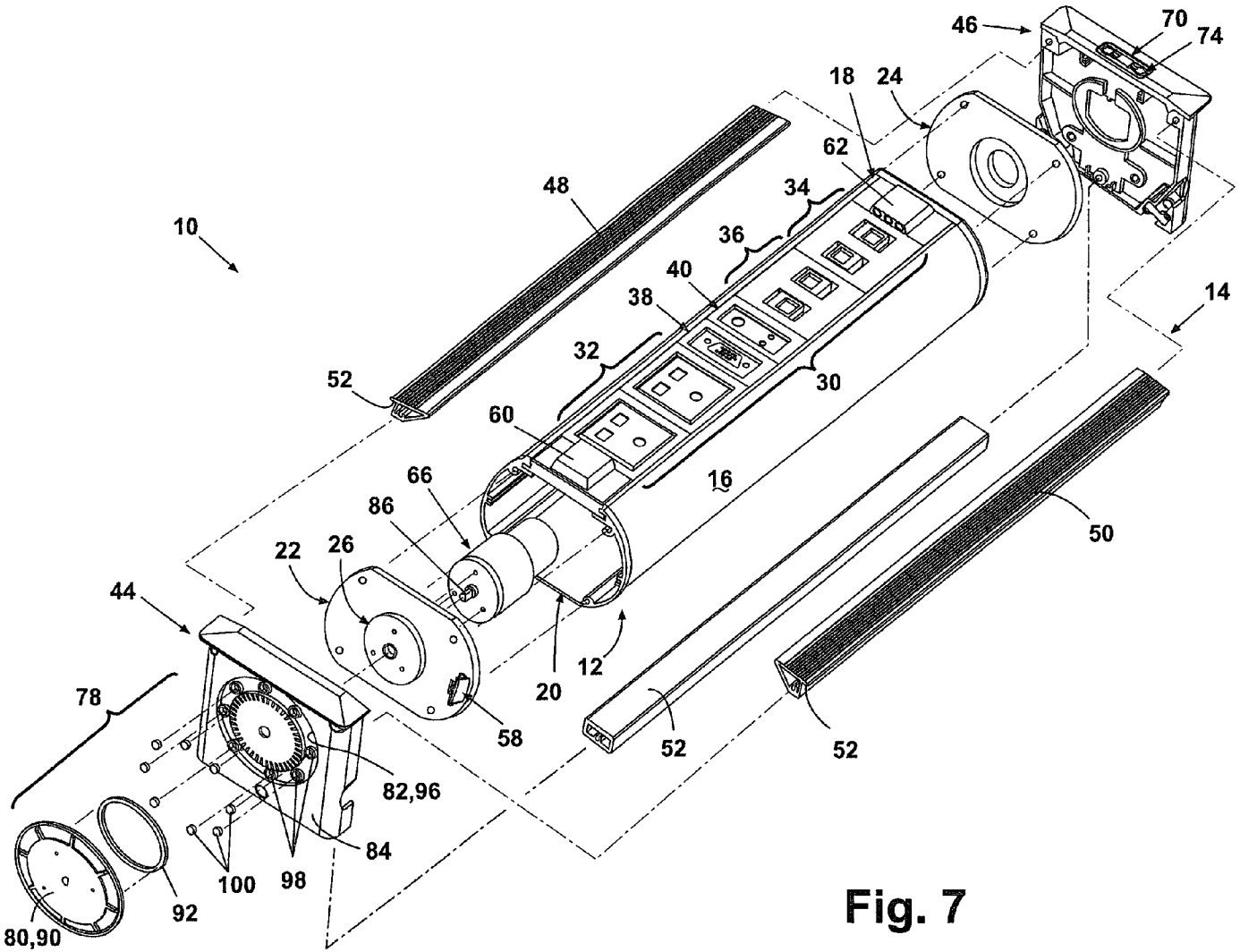
FIG. 7 is an exploded view of the rotary receptacle assembly.
Figure 8:
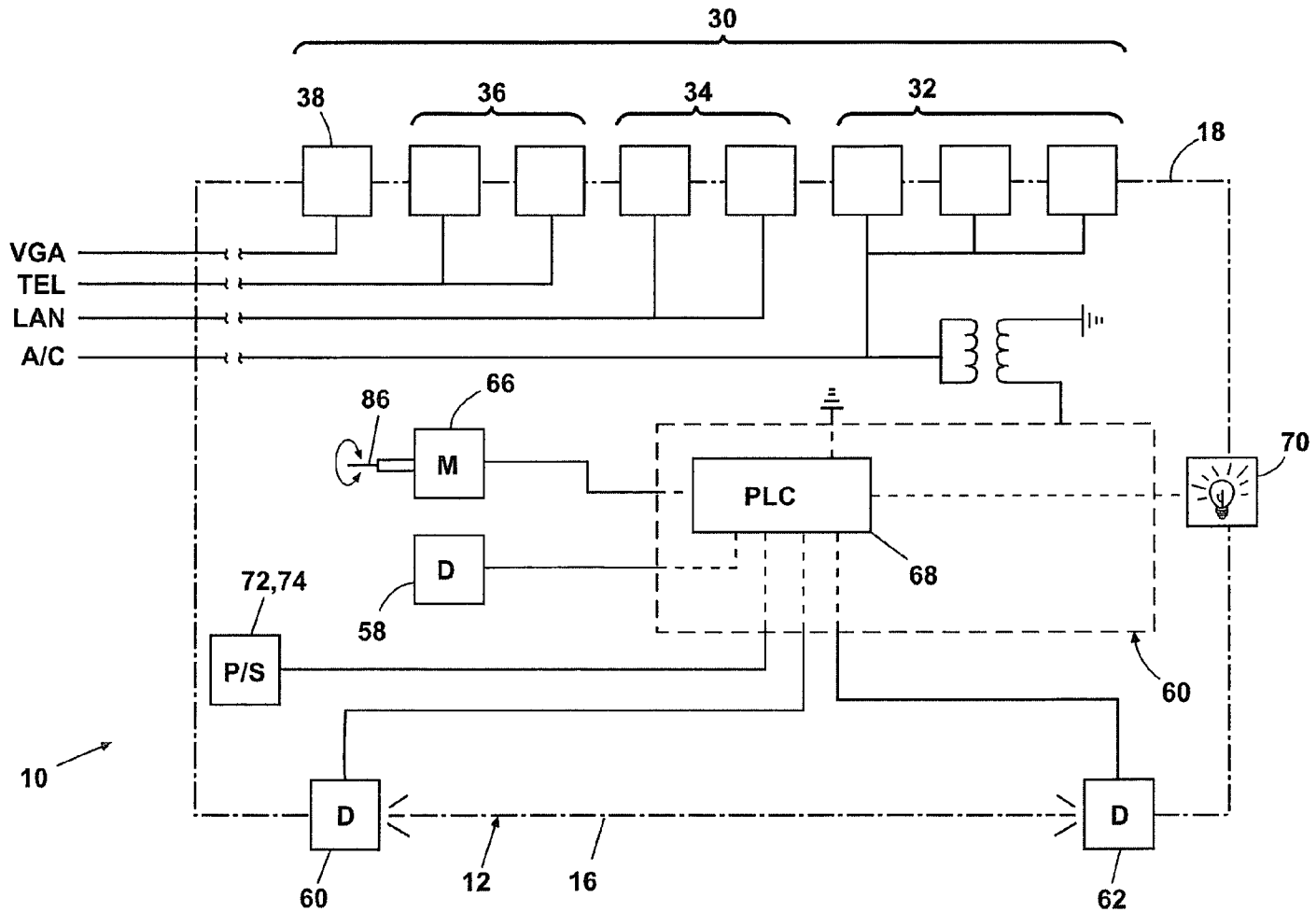
FIG. 8 is a general schematic diagram of the electrical assembly.

The rotary receptacle assembly 10 includes a rotation control assembly 56 comprising drum position detector 58 (FIG. 6) that determines whether the drum assembly 12 is in the concealed or operational position, and detectors 60 and 62 that detect whether the assembly 10 is in use, a control circuit assembly 64 that performs its control function on the basis of the signals received from the detectors 58, 60 and 62, and a motor assembly 66 controlled by the control circuit assembly 64 (see FIGS. 7 and 8). The control circuit assembly 64 is comprised of a CPU circuit 68, a power indicator 70 fixed at one end of the frame assembly 14, and rotation switches 72 and 74. The rotation switches 72 and 74 respectively control the rotation direction of the drum assembly 12. The drum position detector 58 may be employed to determine when a particular rotation angle has been achieved or, when another particularly desired characteristic has been achieved. For example it is anticipated that limit switches such as detector 58 may be mounted to one of the frame or the rotatable drum assembly to interrupt power to the motor assembly 36 when a particular movement has been attained. A more detailed explanation of the invention will be provided by way of the examples described below.

EXAMPLE 1

Figure 4:
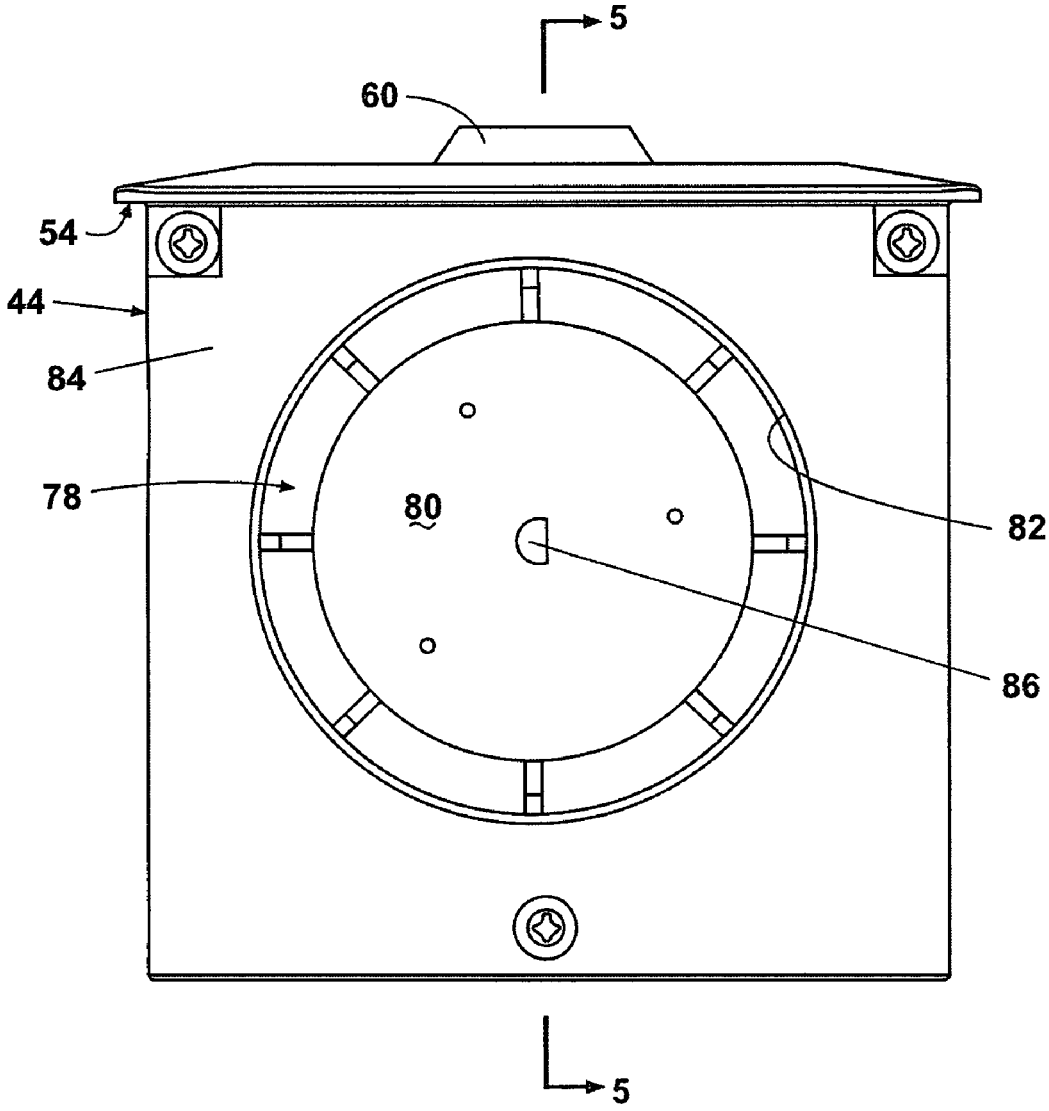
FIG. 4 is a end view of one embodiment of the rotary receptacle assembly.
Figure 5:
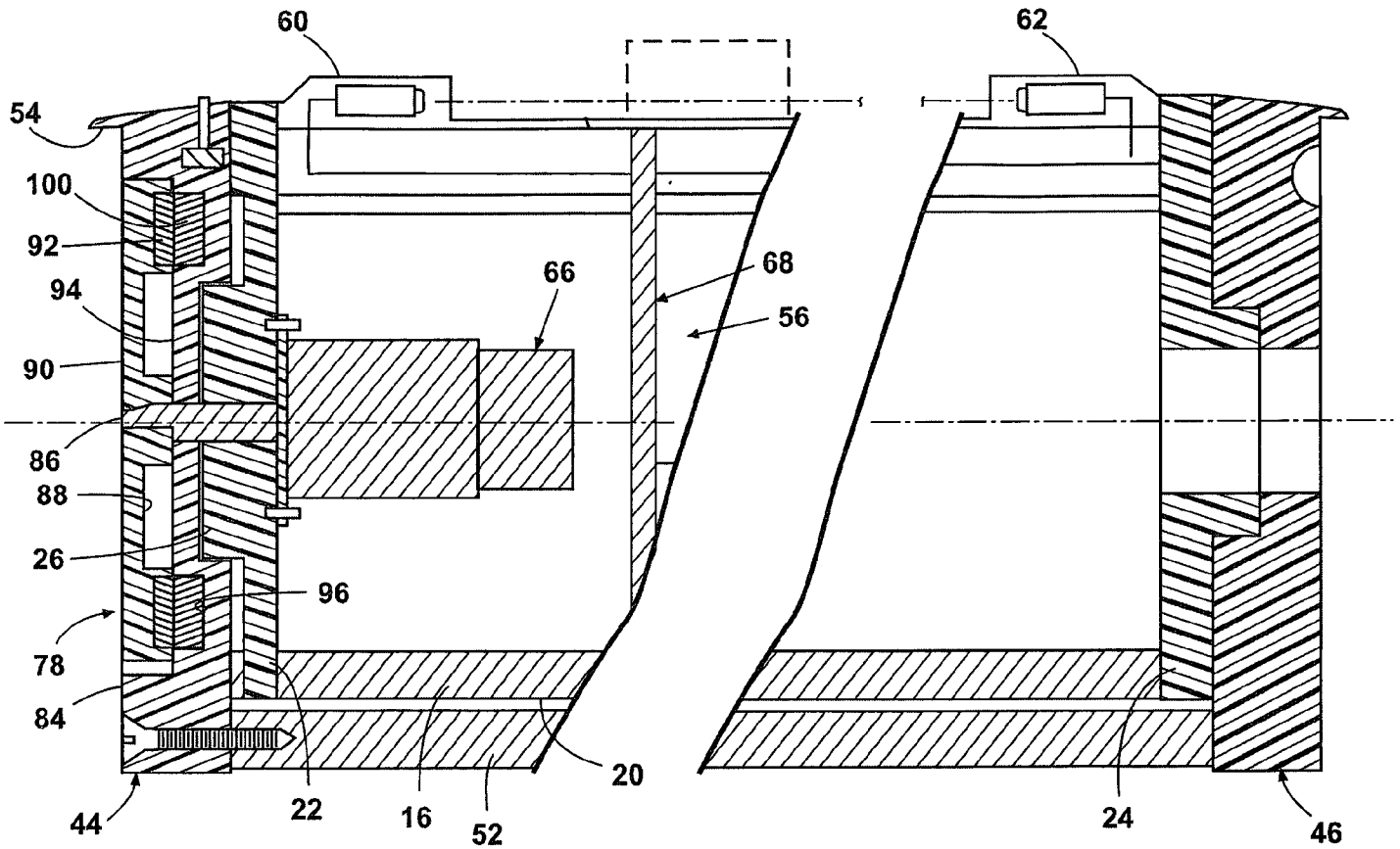
FIG. 5 is a fragmentary section side view of one embodiment of the rotary receptacle assembly taken along line V-V shown in FIG. 4.

FIG. 4 is an end elevation view of the assembly 10. FIG. 5 is a section view of the assembly 10 taken along line V-V shown in FIG. 4. In order to promote rotation of the drum assembly 12, the rotation control assembly 56 within the drum assembly 12 rotates the drum assembly 12 about its longitudinal axis relative to the frame assembly 14. The rotation control assembly 56 includes detectors 60 and 62 that use an optical signal to determine whether at least one of the receptacles 30 is being used. The control circuit assembly 64 performs its control functions based on the optical signals received from the detectors 60 and 62. The control circuit assembly 34 controls the rotary direction of the motor assembly 66 and the supply of power to the motor assembly 66. The housing of the motor assembly 66 is fixed with respect to the tubular body 16 of the drum assembly 12, while the end of the motor assembly shaft is substantially fixed with respect to the end member 44. The motor assembly 66 has sufficient power to drive the rotation of the drum assembly 12 about its longitudinal axis with respect to the frame assembly 14. The detectors 60 and 62 may be comprised of one of a number of sensors, but in a preferred embodiment, include a pair of optical detectors located on the same flat surface 18 of the drum assembly 12 as the receptacles 30. The optical detectors 60 and 62 are disposed at opposite ends of the drum assembly 12 positioned to detect whether any foreign bodies such as a plug 76 are present between the detectors 60 and 62.

The rotation control unit 56 also includes a clutch assembly 78 comprising a rotation disk or clutch plate 80 mounted in frictional engagement with one of the end members of the frame assembly 14 such as 44 that journals one end of the drum assembly 12. The rotation disk or clutch plate 80 may be in the shape of a substantially planar or planar-wave disk configured to be received in a like-shaped clutch recess 82 formed in the exterior end-surface 84 of the end member 44. The rotation disk or clutch plate 50 is fixed to the end of a shaft 86 extending from the motor assembly 66 fixed within the drum assembly 12. The rotation disk or clutch plate 80 is positioned such that substantial friction is created between the rotation disk or clutch plate 80 and the wall of the clutch recess 82 to permit the housing of the motor assembly 66 to rotate the drum assembly relative to the frame assembly 14. However, should the force exerted upon the shaft 86 of the motor assembly 66 be sufficient to over come the friction, the rotation disk or clutch plate 80 may spin about its center to prevent damage to any moving parts of the receptacle assembly 10.

Operation of the embodiment of the rotary power and data center 10 described above is as follows. When using one or more socket or receptacle 30 on the assembly 10, one performs such an operation in the same way as using an electrical outlet, internet connection point, telephone socket, VGA interface, audio and microphone interfaces. If not in use, the operator checks the power indicator 70 to see whether the power is on. If the power is on, the power indicator 70 is illuminated. When in the "ON" position, signals transmitted from one optical sensor or detector 60 may be received by the opposite one of the optical sensor or detector such as 62 located at the top of the assembly 10. See FIG. 1. If there is an object disposed between the two sensors/detectors 60 and 62 such as a plug 76 (for example, the assembly 10 is being used or there is a foreign body on the receptacle assembly) to obstruct the transmission of the signal, the detector such as 60 and 62 output a high level signal sent to the CPU circuit 68 via conductors. The CPU circuit 68 transmits protection control signals via the received high-level signals to ensure that the power is interrupted to the motor assembly 66 to prevent rotation, which makes it impossible for the drum assembly 12 to turn over and, as such, eliminates an electrical safety hazard. If there are no obstructions (i.e.: the assembly 10 is either not being used or there are no objects on the assembly), the optical detector such as 60 and 62 output a low level signal to the CPU circuit 68 via conductors. The CPU circuit 68 transmits rotation-allowed signals via the received low-level signals to control the rotation direction of the motor assembly 66. The positive/negative rotation of the drum assembly 12 is achieved by rotation of the motor assembly 66 to move the drum assembly 12 to a first position exposing the receptacles 30 or to a second position concealing the receptacles 30. In the course of the rotation, if drum assembly 12 should ever experience a halt placing a strain on the motor assembly 66, power failures or there is a need for manual rotation due to the installation specifications, the force of the motor shaft 86 overcomes the friction exerted by the rotation disk or clutch plate 80 with the end member 44 to reduce the risk of damage or injury. Manual rotation of the drum assembly 12 may then be done by hand to clear any obstruction. Once the obstruction is cleared or removed, the friction of the rotation disk or clutch plate 80 with the end member 44 is again sufficient to provide rotation to the drum assembly 12.

EXAMPLE 2

Another embodiment of the invention may be understood by reference to FIGS. 5-7. In the second embodiment, modifications have been to the workings of the rotation disk or clutch plate 80 attached to the end member 44 described above. Another difference lies in the design of the frame assembly 14 as described below.

In the embodiment shown in FIGS. 5-7, the surface 88 of the rotation disk or clutch 90 includes a metal annulus or ring 92 which is facing toward the bottom wall 94 of the recess or depression 96 formed in the end member 44. The bottom wall or surface 94 of the recess 96 proximate the annulus 92 includes a plurality of lesser recesses 98 spaced substantially equidistantly angularly around the clutch engaging surface 94. Within each recess is fixed a magnet 100 so that the metal annular ring or surface 92 is magnetically attracted toward each magnet 100. The metal annulus 92 and the rotation disc or clutch plate 90 are pulled firmly against the end member 44 by the magnetic force exerted by the magnets 100. The magnetic attraction between the annulus or surface 92 of the rotation disk or clutch plate 90 provides a substantially strong coupling that may be overcome by a predetermined amount of force. As in the previous embodiment, the rotation disk or clutch 90 is fixed to the end of the motor shaft 86 enabling the motor housing 66 fixed within the tubular body 16 to rotate the tubular body 16 relative to the frame assembly 14.

In operation under normal circumstances, i.e. with power on, the housing of the motor assembly 66 rotates relative to the shaft 86 and the frame assembly 14, causing the drum assembly 12 to rotate relative to the frame assembly 14. This is because the magnetic force exerted between the rotation disk or clutch plate 90 and the magnets 100 on the end member 44 of the frame assembly 14 is strong, fixing the rotation disk or clutch plate 90 in position, and because the torque force exerted by the motor assembly 66 is insufficient to overcome the friction. If in the course of rotation of the electric motor 66, the drum assembly 12 encounter an obstacle, the torque of the motor assembly 66 on the shaft 86 should be sufficient to overcome the magnetic attraction and rotate the clutch plate 90 until such time as the device 10 shuts off or other intervention occurs to avoid damage to the invention. Moreover, if the unit is unable to be powered or there is a need for manual rotation due to the installation specifications, the motor assembly 66 does not rotate, and the rotation disk or clutch plate 90 will permit rotation of the drum assembly 12 to the desired position. Because the rotation disc or clutch plate 90 and the frame assembly 14 are connected and made stationary by the annulus 92, the rotation disc or clutch plate 90 can be made to rotate when the torque exerted by the motor assembly 66 is greater than the magnetic attraction.

Figure 9:
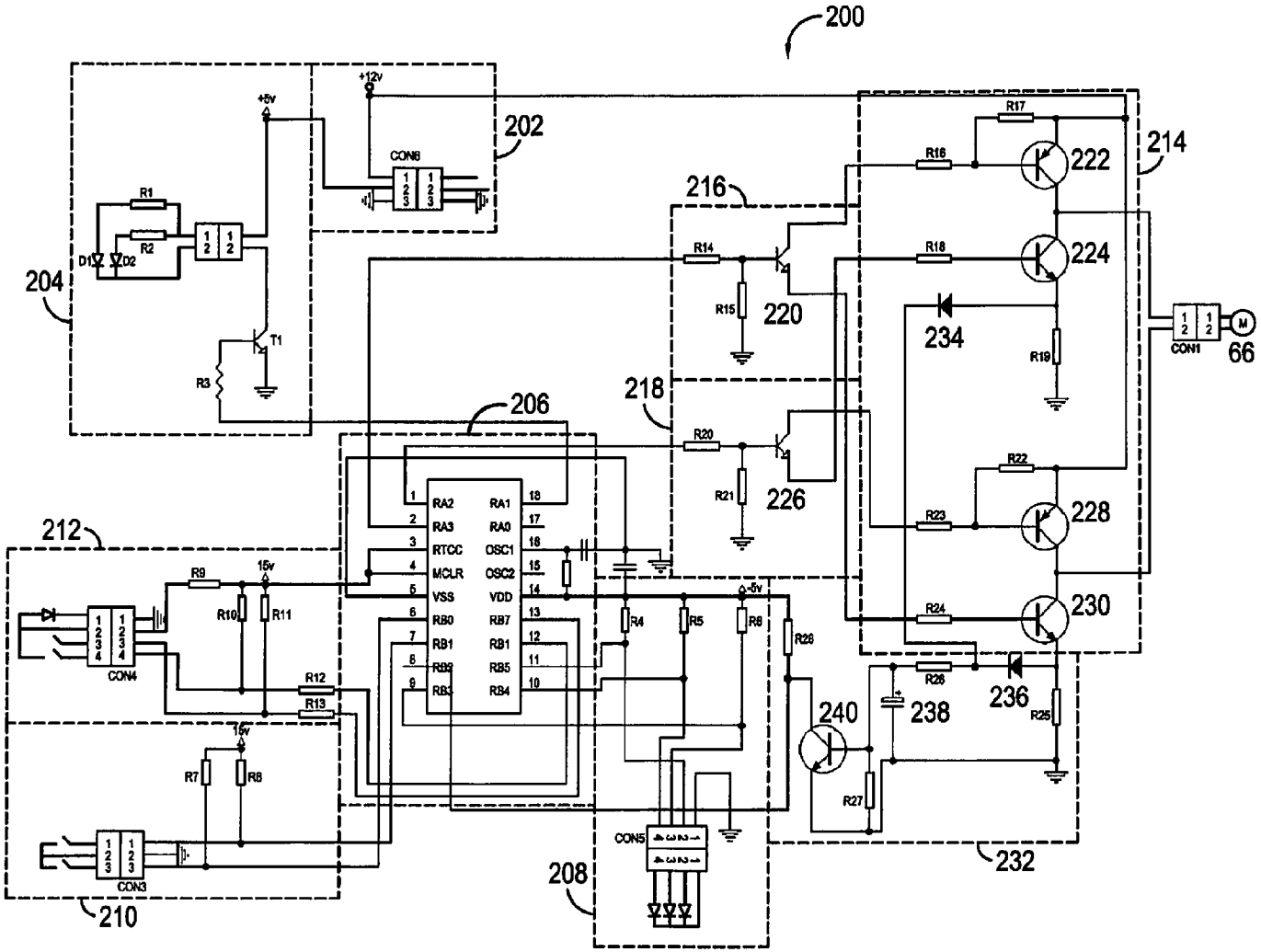
FIG. 9 is a schematic diagram illustrating an alternate embodiment of an electrical assembly.

FIG. 9 illustrates in detail another and preferred embodiment of a circuit assembly 200 that is used to control the rotation function of the invention 10. The circuit assembly detects whether there are any obstructions on the drum that would interfere with rotation when activated, and automatically reverse the direction of rotation if a predetermined level of resistance is encountered when rotating. Circuit assembly 200, simply referred to as the rotation control or RC, begins with a power supply 202 which converts a portion of the 110 volt line power being supplied to the electrical outlets 32 into two reduced voltage lines; one 12 volt line and the other a 5 volt line. The 5 volt lead extending from the power supply 202 passes to a photo transmitter station 204 containing a light emitting diode for showing that power is available as well as powering an array of photo transmitters 205 such as infrared diodes or the like. The photo transmitters 205 ideally are positioned at opposite ends of the receptacles shown above by numerals 60 and 62. From the photo transmitter station 204, the 5 volt power lead is coupled to a programmable logic control circuit 206, also generally known as a PLC. The PLC 206 controls all other functions of the invention 10 based upon input received from the other components described below. All of the following components are operably coupled to the PLC 206, either directly or indirectly.

Also mounted in the detector stations 60 and 62 mentioned above are complimentary photoreceptors or detector array 208. The photo detector array 208 is also coupled to the PLC 206 and provides an appropriate signal when no optical signal is received from the photo transmitters 205. The inability to receive the optical signal from the transmitters 205 suggests that one or more objects are resting on the drum 12. The absence of the photo transmitter beam causes the PLC 206 to prevent the invention from rotating. The path of the beam between the transmitter and the receptor may be very narrow, or alternatively, may be tuned so that only upon maximum intensity, does the system engage and rotate. This way if an object only partially obstructs the path of the beam between the transmitters and detectors, the system will still not function.

As in the previous embodiment of the RC circuit described above, the alternate embodiment 200 also includes rotation limit switches or position control switches 210 which provide a signal when the drum 12 is in the open or in the closed position as well as any position in between. The limit switches 210, when closed, provide an "on" signal aiding the PLC 206 to determine which direction the motor should turn the drum 12. Also operably coupled to the PLC 206 is an operation control switch 212. The control switch 212 allows the user to rotate the drum 12 in either direction until fully open or closed provided there are no obstructions. The control switch 212 may also include a light emitting diode or other indicator showing the direction of rotation as well as the presence of power.

The motor assembly 66 described earlier as a direct current electric motor, is coupled indirectly to the 12 volt side of the power supply 202 through a sub-circuit for switching polarity of the motor leads. Referred to herein as the reversal circuit 214, it utilizes a series of cascading circuits operably coupled to the PLC 206 for changing the polarity of the motor assembly 66 causing it to rotate in one of two directions. The reversal circuit 214 includes a positive drive bus 216 and a negative drive bus 218 both coupled to PLC 206. The positive drive bus 216 may be in the form of a NPN transistor 220 wherein the collector pin is coupled to the base pin of a PNP transistor 222 having the collector pin coupled to the positive side of the power supply 202. The emitter pin of the PNP transistor 222 is operably coupled to one of the leads for the motor assembly 66. The emitter pin of PNP transistor 222 is also coupled to a collector pin of a second NPN transistor 224 wherein the emitter pin is coupled to ground. In a like fashion, the reverse drive bus 218 is connected to the opposite lead of the motor assembly 66. A NPN transistor 226 is coupled by the base pin to the PLC 206. The collector pin of the NPN switch 226 is operably connected to the base pin of a PNP transistor 228. The collector of the PNP transistor 228 is also connected to the positive side of the power supply 202. The emitter pin of the PNP transistor 228 is connector to the collector of a second NPN transistor 230 wherein the emitter is coupled to ground. The emitter sides of transistors 222 and 226 in each bus 216 and 218 are coupled respectively to the base pins of the NPN transistors 230 and 224. Thus, the direction of rotation of the motor 66 is based upon a signal generated by the PLC 206 to one of the transistors 220, 226.

The RC 200 in this embodiment of the invention also includes a feature where the drum 12 automatically reverses rotation direction upon detecting an obstruction. This is achieved by monitoring the current required to drive the motor assembly 66. This is accomplished by a rotation sample hold circuit (RSHC) 232 operably coupled to the emitter pins of transistors 224 and 230. The emitter of each transistor 224 and 230 is coupled to a respective diode 234, 236. The amount of current to open and close the drum 12 are then compared against one another by the RSHC 232 via a capacitor 238 and a transistor 240 wherein the PLC 206 detects the amount of current lost to the RSHC 232. Thus, when the transistor 240 is allowing current to flow the PLC 206 auto reverses the rotation direction or stops the rotation of the drum 12 to prevent any damage because of an obstruction. The PLC 206 may be programmed to reset or automatically reverse the direction.

Figure 10:
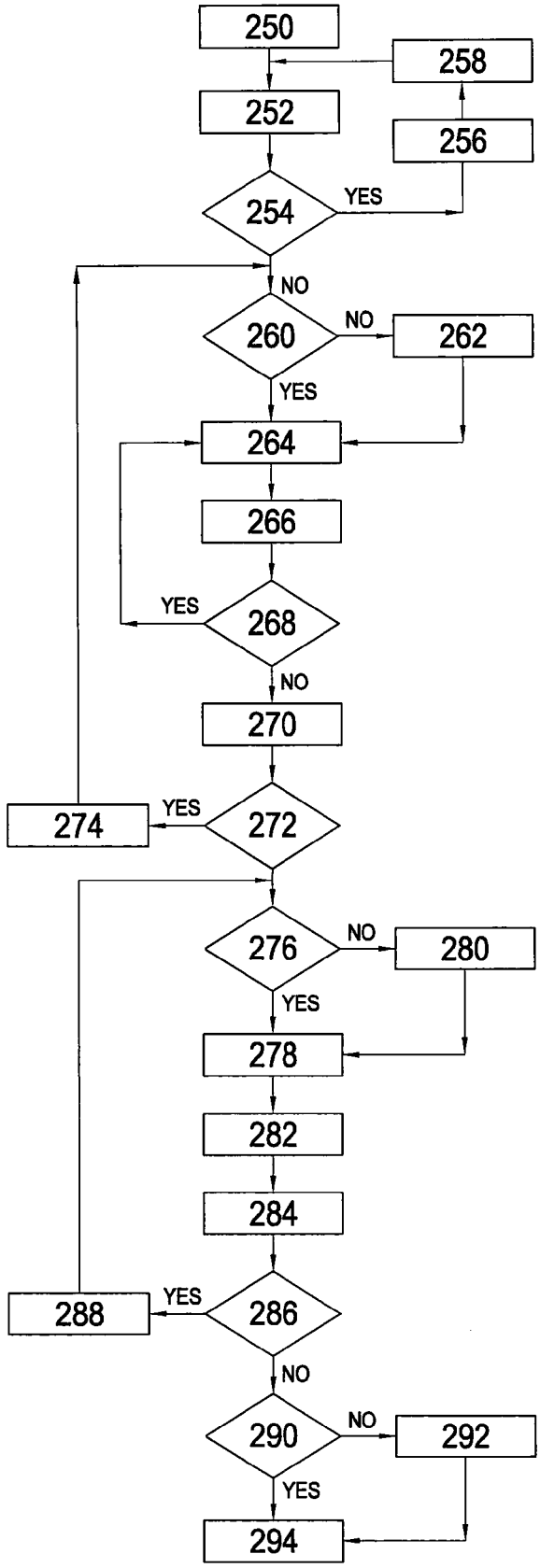
FIG. 10 is a flow diagram outlining logic of a programmable logic control that may be used in association with the invention.

FIG. 10 is one version of a flow diagram depicting one logic that may be used in conjunction with the PLC 206 described above. The logic diagram depicts only one such logic that may be adapted or programmed for the PLC 206. Other of ordinary skill in the art may elect to use alternative forms of logic including, but not limited to EPROMs, microprocessors, or logic circuits that are more elemental.

The logic shown in FIG. 10 begins with the step of initialization 250 commenced with the supply of power. Upon the receipt of power the PLC 206 gives instruction to positive drive bus 216 to rotate the drum 12 to the open position shown by box 252. While in rotation, the RSHC 232 is monitoring the amount of current needed to complete the rotation suggested by decision box 254. Should there be an anomaly, the PLC 206 sends a signal to reverse drive bus 218 causing the drum 12 to rotate in the opposite direction and close shown by box 256. The operator will then be required to depress the "open" button 212 to try to reopen the invention as depicted by box 258. Should the rotation of the drum 12 continue, power is ceased to the motor assembly 66 when the limit switches 210 indicate the drum 12 has reached the appropriate orientation shown by decision box 260. It the rotation is not complete, a count down is commenced at 262 before power is terminated by the buses 216, 218 as shown by 264. If the position is reached and a signal is generated by the limit switches 210, power is halted at box 264.

To close the invention, the operator depresses operation switch 212 suggested by box 266. The PLC 206 as indicated by decision box 268 determines whether there is an obstruction by the generation of the signals at the photo transmitters 204 and received by the photo receivers 208. If the signal is sufficient, closing rotation commences as indicated by box 270. Stall of the rotation is determined by decision box 272. If the current draw exceeds the established level, decision 272 forces the reverse rotation of the drum 12 shown by box 274 until the limit switches again show the drum is in the right position by box 260 when current is disconnected. If not in the position required by the limit switches, a countdown is again commenced at which point power is terminated leaving the drum 12 in the stuck position as shown by boxes 262 and 264. The operator then must intervene reactivate by the operation switch, and the process goes through the steps indicated by boxes 260 through 272 once again. However, if the rotation is commencing smoothly, it continues until the drum 12 has reached the correct position as indicated by decision box 276.

When the limit switch 210 is activated power is terminated as shown by box 278. If the limit switch 210 is not activated, the count provided by box 280 is commenced. If time expires power is interrupted so as not to damage the invention. The process is repeated when the operator then wishes to reopen the invention by depressing switch 212 shown by box 282. The direction of rotation is determined by PLC 206 at box 284 and the current is again monitored at decision box 286. Rotation continues until the current exceeds the threshold at which rotation direction is reversed at box 288 and the logic is reverted to box 276, or the drum continues to rotate until the desired position is reached as shown by decision box 290. Again if the rotation is not completed within a specified time set by clock 292, power is interrupted as shown by box 294 and the reset process must be repeated.

The different embodiments described herein are provided merely as examples of this practical new design and represent only the embodiments known to date by the inventors. Modifications of the invention could be made by those skilled in the art and to those who make or use the invention that would be considered within the scope of the invention. Therefore, it is understood that the embodiments shown in the drawings and described above are merely for illustrative purposes and not intended to limit the scope of the invention.

The invention claimed is:

1. A receptacle assembly, comprising:

a frame assembly;

a drum assembly journaled to said frame assembly so that said drum assembly may rotate relative to said frame assembly, said drum assembly including at least one receptacle;

a motor assembly mounted to one of said frame assembly and said drum assembly for rotating said drum assembly in a first and second direction relative to said frame assembly; and a circuit assembly operably coupled to said motor assembly for one of stopping said motor assembly and reversing said motor assembly in response to a current draw by said motor assembly.

2. The receptacle assembly as defined in claim 1, further comprising at least one sensor assembly mounted to a surface of the receptacle assembly and operably coupled to said circuit assembly for preventing said motor assembly from operating when an object is detected by said sensor assembly.

3. The receptacle assembly as defined in claim 1, further comprising a second sensor assembly mounted to one of said frame assembly and said drum assembly for detecting a predetermined rotation angle of said drum assembly relative to said frame assembly and interrupting said motor assembly.

4. The receptacle assembly as defined in claim 1, further comprising a clutch assembly interconnecting said motor assembly to said drum assembly.

5. The receptacle assembly as defined in claim 1, wherein said frame assembly comprises:

a first and a second end member spaced from one another, each said first and second end member including a member for journaling said drum assembly there between;

a plurality of spans interconnecting said first and said second end member; and a flange depending from said first and said second end member and said plurality of spans for engaging a surface of a substrate.

6. The receptacle assembly as defined in claim 1, wherein said drum assembly comprises:

a body having opposing first and a second ends;

an journal member mounted to each of said first and second ends for defining an axis of rotation for said drum assembly; and wherein said at least one receptacle is mounted to a predetermined position on said body.

7. The receptacle assembly as defined in claim 1, wherein said sensor assembly comprises:

a first detector mounted to said drum assembly proximate said first end;

a second detector mounted to said drum assembly proximate said second end and able to detect a signal from said first detector and send a signal to said first detector;

a control circuit unit operably interconnected to said first detector and said second detector; and a CPU circuit operably coupled to said control circuit unit, said first and said second detector, and to said motor assembly for operably controlling a rotation direction of said motor assembly.

8. The receptacle assembly as defined in claim 4, wherein said clutch assembly comprises:

a clutch recess formed in an end of said frame assembly; and a clutch plate disposed within said clutch recess in intimate contact with a surface of said frame assembly and coupled to said motor assembly.

9. The receptacle assembly as defined in claim 4, wherein said clutch assembly comprises:

a clutch recess formed in an end of said frame assembly;

a clutch plate disposed within said clutch recess and coupled to said motor assembly;

a magnetic material attached to a surface of one of said clutch recess and said clutch plate; and at least one magnet attached to an opposite one of said clutch recess and said clutch plate having said magnetic material attached thereto.

10. An power and data center assembly for selectively revealing and concealing at least one receptacle on a substrate, comprising:

a frame assembly;

a receptacle assembly journaled to said frame assembly such that said receptacle assembly rotates about at least one axis relative to said frame assembly;

a motor assembly mounted within said receptacle assembly and interconnected to said frame assembly for selectively rotating said receptacle assembly about said at least one axis between a first position and a second position; and a first sensor array mounted to said receptacle assembly for detecting an obstruction on said receptacle assembly;

a second sensor array operably coupled to said motor assembly for selectively operating said motor assembly based upon one of an angle of rotation; and a third sensor array operably coupled to said motor assembly for selectively operating said motor assembly when said receptacle assembly encounters an obstruction.

11. The power and data center assembly as defined in claim 10, further comprising a clutch assembly interconnecting said motor assembly to said receptacle assembly.

12. The power and data center assembly as defined in claim 10, wherein said first sensor array comprises a detector array for detecting whether the receptacle assembly is in use.

13. The power and data center assembly as defined in claim 10, wherein said second sensor array comprises at least one detector array for detecting a rotation angle of said receptacle assembly.

14. The power and data center assembly as defined in claim 10, wherein said third sensor array comprises a circuit for detecting a draw of current by said motor assembly.

15. The power and data center assembly as defined in claim 12, wherein said detector array comprises a first and a second photo-electric sensor mounted to opposite ends of said receptacle assembly.

16. The power and data center assembly as defined in claim 15, wherein said first and said second photo-electric sensor are selected from the group of invisible light and visible light devices.

17. A rotary power and data center, comprising:

a frame assembly;

a receptacle assembly journaled to said frame assembly for rotation about a longitudinal axis of said receptacle assembly;

a motor assembly attached to one of said frame assembly and said receptacle assembly for rotating said receptacle assembly about said longitudinal axis between a first and second position; and a circuit assembly operably coupled to said motor assembly for one of stopping said motor assembly and changing a direction of rotation of said receptacle assembly based upon a signal indicating said receptacle assembly is obstructed from rotating.

18. The rotary power and data center as defined in claim 17, further comprising a clutch assembly interconnecting said motor assembly to said receptacle assembly.

19. The rotary power and data center as defined in claim 18, wherein said clutch assembly comprises:

a clutch wall defined on said frame assembly; and a clutch plate in intimate frictional contact with said clutch wall and attached to said motor assembly.

20. The rotary power and data center as defined in claim 18, wherein said clutch assembly comprises:

a clutch wall defined on said frame assembly;

one of a magnet and a ferrous material attached to said clutch wall; and a clutch plate having an opposite one of said magnet and said ferrous material disposed thereon and drawn toward said clutch wall by a magnetic force exerted between said magnet and said ferrous material.

* * * * *